United States Patent [19]

Harris

[11] Patent Number: 5,075,907

[45] Date of Patent: Dec. 31, 1991

[54] FLUSH TANK WATER SAVER

[76] Inventor: John L. Harris, 470 Palm Island NE., Clearwater, Fla. 34630

[21] Appl. No.: 521,892

[22] Filed: Apr. 9, 1990

Related U.S. Application Data

[63] Continuation-in-part of Ser. No. 293,454, Jan. 4, 1989, Pat. No. 4,941,214, and Ser. No. 319,263, Mar. 6, 1989, Pat. No. 4,945,581, which is a continuation of Ser. No. 30,080, Mar. 26, 1987, abandoned.

[51] Int. Cl.[5] ..... E03D 1/14

[52] U.S. Cl. ..... 4/325; 4/415

[58] Field of Search ..... 4/324, 325, 381–387, 4/391–397, 415

[56] References Cited

U.S. PATENT DOCUMENTS

| | | | |
|---|---|---|---|
| 823,832 | 6/1906 | Wayman . | |
| 2,532,977 | 12/1950 | White . | |
| 4,017,912 | 4/1972 | Young, Jr. . | |
| 4,032,997 | 9/1975 | Phripp et al. . | |
| 4,483,024 | 11/1984 | Troch | 4/324 |
| 4,651,359 | 3/1987 | Battle | 4/324 |

*Primary Examiner*—Linda J. Sholl

[57] ABSTRACT

A flush tank water saver has an elongated semi-circular base fitting around and clamped to the overflow pipe. This base carries an operating lever on pivots close to the flapper valve pivots. This lever engages the flapper valve at its center and pushes it in exactly the direction it is going, eliminating friction losses. The lever is operated to push the valve closed by a float mounted on the other side of the overflow pipe on a vertical guide. The float operates a float lever connected to the valve operator. A stop for the float is brought into place by the flush lever. If the user holds the flush handle down for two seconds the float engages the stop and is inoperative for that flush. This provides a full flush. In the second species the valve operating lever pivot is near the water saver cut-off level and the lever is spring biased downwardly behind the flapper valve to push it closed. It is moved to valve open position by the flush lever at the start of a flush and held there by a latch which is released by a float at the water saver cut-off level. The valve pivot is located horizontally to cause the points of contact between the valve operator and flapper valve to travel in the same general direction, minimizing friction loss.

16 Claims, 4 Drawing Sheets

FIG. 1
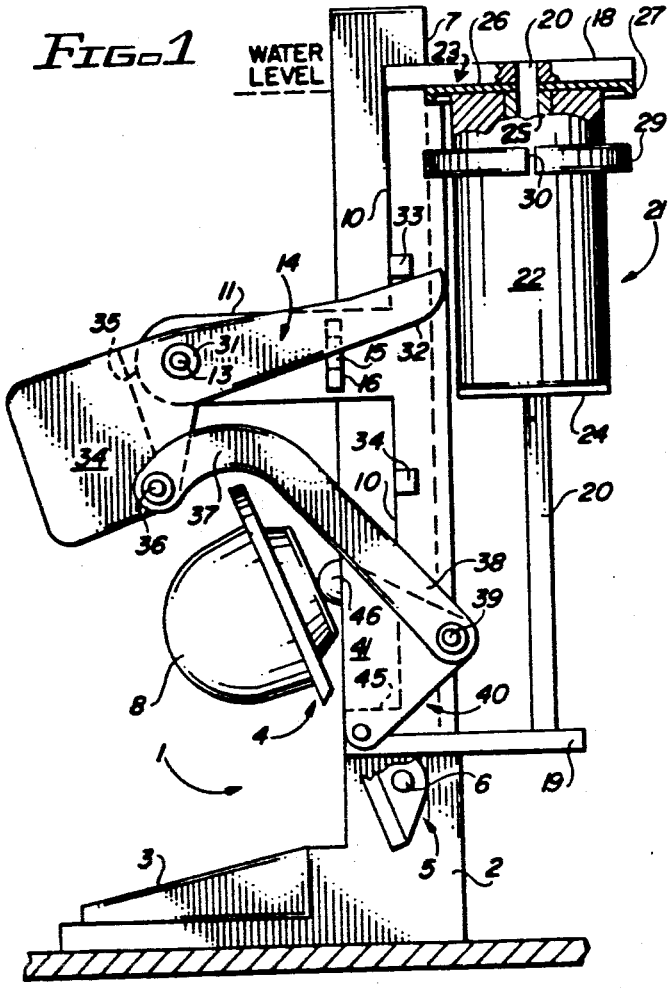
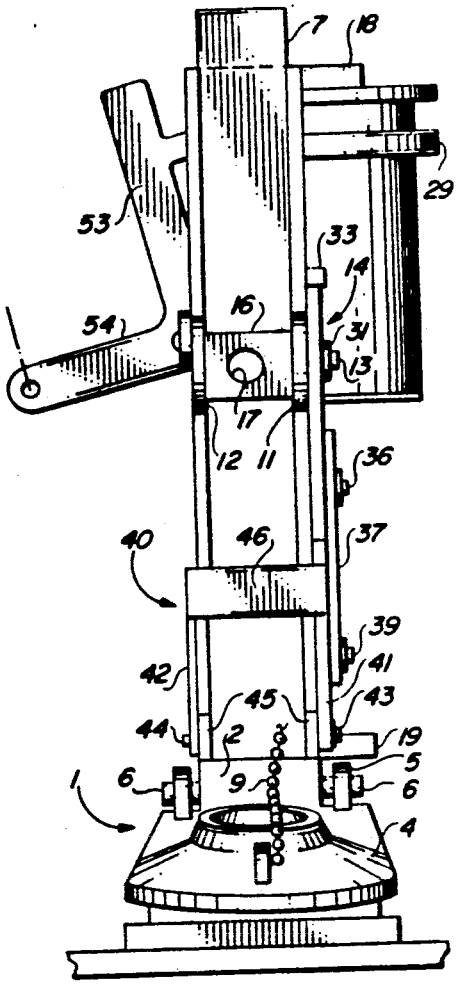
FIG. 2
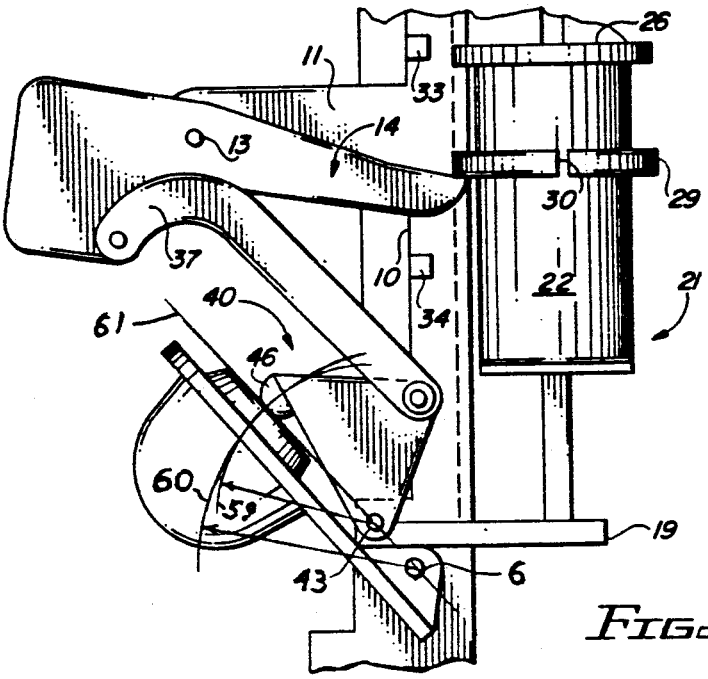
FIG. 3

FLUSH TANK WATER SAVER

This application shows and claims two species of a water saver flapper valve operator for toilet flush tanks, FIGS. 1 to 6 and FIGS. 7 to 13. The species of FIGS. 1–6 is shown in my applicaton Ser. No. 07/319263, filed Mar. 6, 1989 (original Ser. No. 07/030,080 filed Mar. 3, 1987). The species of FIGS. 7 to 13 is shown in my application Ser. No. 07/293454 filed Jan. 4, 1989. This application is a continuation-in-part of applications Ser. No. 07/319,262 filed Mar. 6, 1989, now U.S. Pat. No. 4,945,581 and Ser. No. 07/293,454 filed Jan. 4, 1989, now U.S. Pat. No. 4,941,214. Application Ser. No. 07/319,263 is a continuation of Ser. No. 07/030,080 filed Mar. 3, 1987, now abandoned.

BACKGROUND OF THE INVENTION

This invention relates to toilet tank controls for selectively providing a water saving short flush or a full flush.

It has long been recognized that toilet flush tanks are one of the worst water wasters in existence. They are flushed often and each time use a full tankful even though less than half would give an adequate flush for most uses.

Many attempts have been made to develop suitable devices giving the user a choice between a short flush or a full flush. To date, in spite of the demand for water saving, none is on the market. In these devices an extra float is used for pushing the tank flush valve closed before the tank is empty. In the older patents, the float pushes a ball valve straight down. In the newer patents, the float moves straight down and pushes at an angle on the back of the new type pivoted float-flapper valve. These flapper valves are made of a very soft and flexible rubber. Pushing at an angle involves considerable friction loss and the inherent "wobble" of the soft rubber, plus rubbing over trademark raised characters on the flapper valve gives inconsistent results.

SUMMARY OF THE INVENTION

The present invention is a unitary device that slips over the overflow tube of a flush tank and is held in place by a thumb screw. It includes a pivoted flapper valve operator engaging in what is the back of the flapper valve when open. This engagement is at the center of the valve and extends over a substantial area, minimizing the "wobble" effect of the soft rubber.

This lever pushes the flapper valve in the same direction it is going, eliminating friction. In one embodiment it is rocked by a vertically guided float on the other side of the overflow tube and pushes the flapper valve closed when the water level is about half way down.

Provision for a full flush is obtained by a latch for holding the float up. This latch is moved into latching position by the flush lever. For a full flush the user holds the flush lever down until the float drops to engage it (about 1½–2 seconds).

The primary object of the present invention is to provide a simple, low cost and dependable unit that may be successfully attached to existing flush tanks by unskilled persons.

A further object of the invention is to provide a simple adjustment requiring no tools for adapting the device to installations of varying characteristics.

Other objects will appear from the following detailed description and appended claims.

BRIEF DESCRIPTION OF THE DRAWINGS

FIG. 1 is a front elevation of the water saver with the parts in the positions assumed at the start of a flush.

FIG. 2 is an end view of FIG. 1 showing the parts in the positions assumed when the tank is full before a flush.

FIG. 3 is a fragmentary view similar to FIG. 1 but showing the parts in the positions at approximately the end of a short flush.

DETAILED DESCRIPTION—FIGS. 1 TO 6

Figure 4:
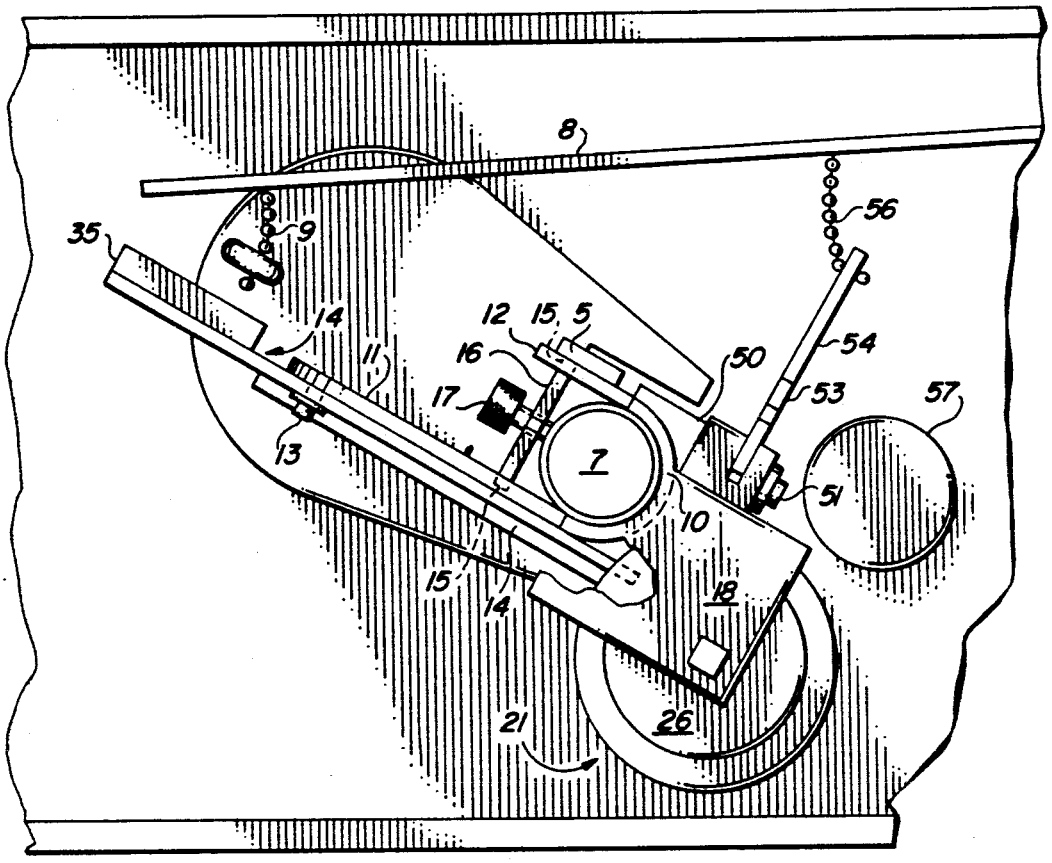
FIG. 4 is a top view showing the installation in a typical flush tank.

Referring to FIGS. 1 and 2, reference character 1 indicates generally the outlet valve mechanism of a typical modern flush tank. This includes a base member 2 having an outlet valve port 3 normally covered by a float type flapper valve 4. As usual, this flapper valve is provided with ears 5 on both sides of the base pivotally mounted to supports 6 formed on the base. This part of base 2 having supports 6 is part of an overflow pipe means including an overflow pipe 7 extending above the water level indicated. The flapper valve 4 is operated by a flush lever 8 (FIG. 4) which is connected to the valve by a chain 9. When the flush lever 8 is moved upward by an external flush lever (not shown) it pulls the flapper valve 4 from its seat and the float portion 8 causes it to move to the wide open position of FIG. 1. When the water level drops below float 8, the flapper valve rotates about its pivots and falls into its closed position of FIG. 2. The part so far described is standard equipment in typical flush tanks.

The invention to be described is an attachment that may be easily installed in existing flush tanks. This attachment includes an elongated molded plastic semi-circular base 10 fitting around the right side of the overflow pipe 7 as seen in FIGS. 1 and 4. This semi-circular base is open on one side providing a rigid channel-like construction that can easily be fabricated. Near the middle of the base are two extensions from the semi-circle, 11 and 12 (FIG. 4). Extension 11 extends a substantial distance from the overflow tube 7 and carries a pivot pin 13 supporting a float lever 14. Extension 12 is shorter as shown in FIG. 4. Extensions 11 and 12 have slots as at 15 which support a mounting clamp 16 carrying a knurled set screw 17. This set screw firmly holds the semi-circle base 8 against the overflow tube 7. It should be noted that the curved engagement surfaces at the ends of the base member 10 are spaced axially on the overflow pipe and hold the base 10 parallel with the overflow pipe. The single clamp 17 engages the overflow pipe on the side opposite the curved surfaces at a point axially spaced between the surfaces and pulls both of those surfaces into contact with the pipe.

The semi-circle base member 10 has integral float supports 18 and 19 at its upper and lower ends. These are in vertical alignment and support a square float guide rod 20 supporting a cylindrical float 21. This guide means 20 allows float to move up and down substantially parallel with the overflow pipe 7.

The float 21 may be formed of a cylindrical mid-portion of soft light material such as foam plastic. It has molded end portions 23 and 24 of wear resistant material such as DELRIN # which engage the guide 20. As shown in FIG. 1 the top end piece 23 has a guide portion 25 extending into the cylindrical section and engaging rod 20. It also has a flat section 26 extending outwardly beyond the cylindrical section 22 and has a down turned edge portion 27. The purpose of this construction will appear later.

The float 21 also includes a vertically adjustable ring 29 mounted on the cylindrical mid-portion 22. The ring is molded of a suitable wear resistant material such as DELRIN # with a split 30. It is molded with a diameter slightly less than cylinder 22 and the split 30 allows it to expand for a friction fit on the float. The lower surface of ring 29 is thus a vertically adjustable contact surface on the float for actuating the float lever 14.

This float lever is pivotally mounted on stud 13 supported by base 10 and is held in place by a retainer 31. The float operated end 32 extends past the overflow pipe 7 to a position under the float ring 29 and has its travel limited by an upper stop 33 and a lower stop 34 molded on base 10. The operating end of lever 14 is enlarged as at 34 and carries a weight 35 (FIG. 4) for biasing it in a counterclockwise direction against upper stop 33. This float lever also is formed with a stud 36 pivotally supporting a link 37 extending over the flapper valve and having its end 38 pivotally attached to a stud 39 formed on a flapper valve operator generally indicated as 40.

This operator has two leg portions 41 and 42 pivotally mounted on studs 43 and 44 supported by extensions 45 on base 10. The studs are near pivots 6 for the flapper valve. The legs 41 and 42 are connected by a flapper valve operating portion 46 extending across base 10 behind the center of flapper valve 4. When it is in open position as shown in FIG. 1, it will be apparent that when the float lever 14 is rocked clockwise by downward movement of the float, the operating means consisting of lever 14, link 37 and operator 40 will push the flapper valve 4 toward closed position. It will also be apparent that the float and flapper valve are on different sides of the overflow pipe. The float is adjacent the overflow pipe and moves in a path parallel with the pipe in an area spaced laterally from the flapper valve.

As will be explained in detail under "OPERATION", the mechanism described above will provide a water saving short flush. To get a full flush, the user would have to hold the flush handle down until the tank empties. This would not be acceptable commercially.

The invention further includes a means involving no changes in the flush tank for giving the user a quick choice between a short flush and a full flush. This will now be described referring to FIGS. 4 and 5.

Figure 5:
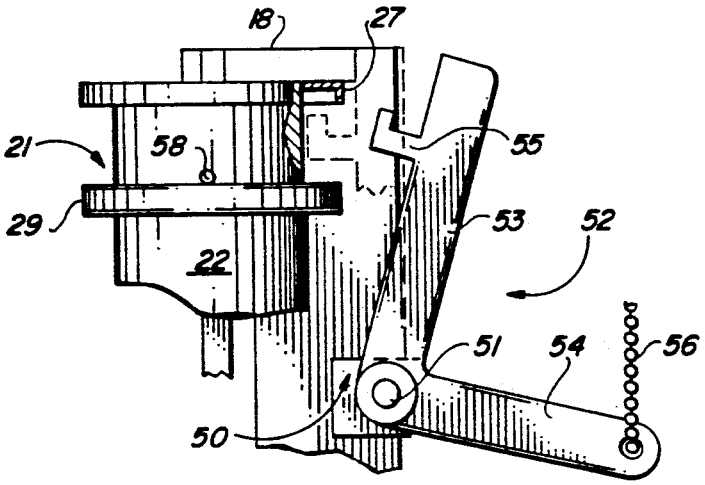
FIG. 5 is a fragmentary end view at the opposite end from FIG. 2, showing the arrangement providing a full flush.
Figure 6:
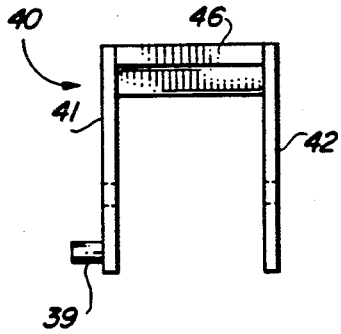
FIG. 6 is a top view of the flapper valve operator shown in the position of FIG. 3.

Molded integrally on base 10 is a boss 50 having a long stud 51. This stud carries a locking means for the float consisting of a bell crank lever 52 having arms 53 and 54. Arm 53 carries a float locking portion 55 extending inwardly and then upwardly. Arm 54 extends to the right as shown in FIG. 5 and is connected by a chain 56 to the flush lever 8 which also operates the flapper valve (FIG. 4).

OPERATION

FIG. 2 shows the parts in normal inactive position. The flapper valve is closed, the flush tank is full and the float is at its top position pressing against float support 18. This float is designed with a buoyancy to cause it to extend about 1" above the water level when free. The flush lever is in its down position allowing slack in flapper valve chain 9 and bell crank chain 56. The bell crank or control means 52 is in the full line position of FIG. 5 (first mode), causing its locking portion 55 to be out of the downward path of the float.

When a partial flush is desired, the user presses on the external flush lever and releases quickly. The bell crank 52 is first rotated to its dotted line float locking position (second mode) and then allowed to retract out of the path of the float. This same upward motion of flush lever 8 pulls the flapper valve off its seat and the flapper valve due to the buoyancy of float 8 opens to the position of FIG. 1. Its top center presses against bar 46 of the operator 40.

The water level starts dropping rapidly. It will drop the first inch in about 1¼ seconds at which time the float starts moving down. This allows time for the user to release the flush lever and for bell crank 52 to rotate out of the way.

The float will continue dropping and ring 29 will engage float lever 14 causing it to rock clockwise about its pivot 13. This causes movement of link 37 to the left, rotating flapper valve operator 40 counterclockwise about its pivot pins 43 and 44. When the parts reach the approximate positions shown in FIG. 3, the exposure of the top of the flapper valve to the down rushing water will create a downward force sufficient to overcome the buoyancy of float 8. The flapper valve will now snap closed. The water level at which this occurs may be adjusted by moving ring 29 up or down on the float. The ring in FIG. 5 is shown in its top-most position where adjustment is stopped by a stop pin 58.

When a full flush is needed, the user holds the flush handle down about two seconds. The float locking portion 53 of bell crank 52 will still be in the dotted line locking position shown in FIG. 5 when the float drops. This will stop the float from dropping. The upward extension on locking portion 55 is behind the downward lip 27 on the float. This holds the locking lever in locking position until the tank refills causing the float to rise and release lever 52. The arrangement just described renders the float inoperative by the conjoint action of the float and flush lever. As the float is now inoperative, the regular flushing mechanism will go through a full flush.

The arrangement in which the flapper valve operator is pivotally mounted near the flapper valve pivots provides for almost frictionless driving of the flapper valve by the operator. Referring to FIG. 3, arc 59 is the path traveled by the point of contact of crossmember 46 of the valve operator with the flapper valve. Arc 60 is the path traveled by the point of contact on the flapper valve with the operator. It should be noted these two paths of travel practically coincide through the operating range of the operator 40. This operating range is approximately from the position of crossmember 46 shown in FIG. 1 to that shown in FIG. 3. These coinciding paths eliminate friction loss and make the action of float 21 more effective and accurate. The arrangement of the operator crossover bar 46 extending across the flapper valve avoids distortion of this soft rubber part. This further contributes to accurate and consistent operation.

The basic reason the two paths of travel substantially coincide through the operating range of the operator is the location of the operator pivots 43 and 44 relative to the valve pivots 6. As shown in FIG. 3, the operator pivots 43 and 44 are in the vicinity of a line from the valve pivots 6 through the area of contact of the operator and valve when the operator is pushing the valve to closed position. To show this relationship more clearly, an imaginary line 61 is included in FIG. 3 and goes from the center of valve pivot 6 through the point of contact of operator bar 46 with the valve. The operator pivot 43 is on this line and the two paths practically coincide.

DETAILED DESCRIPTION—FIGS. 7 TO 13

Figure 7:
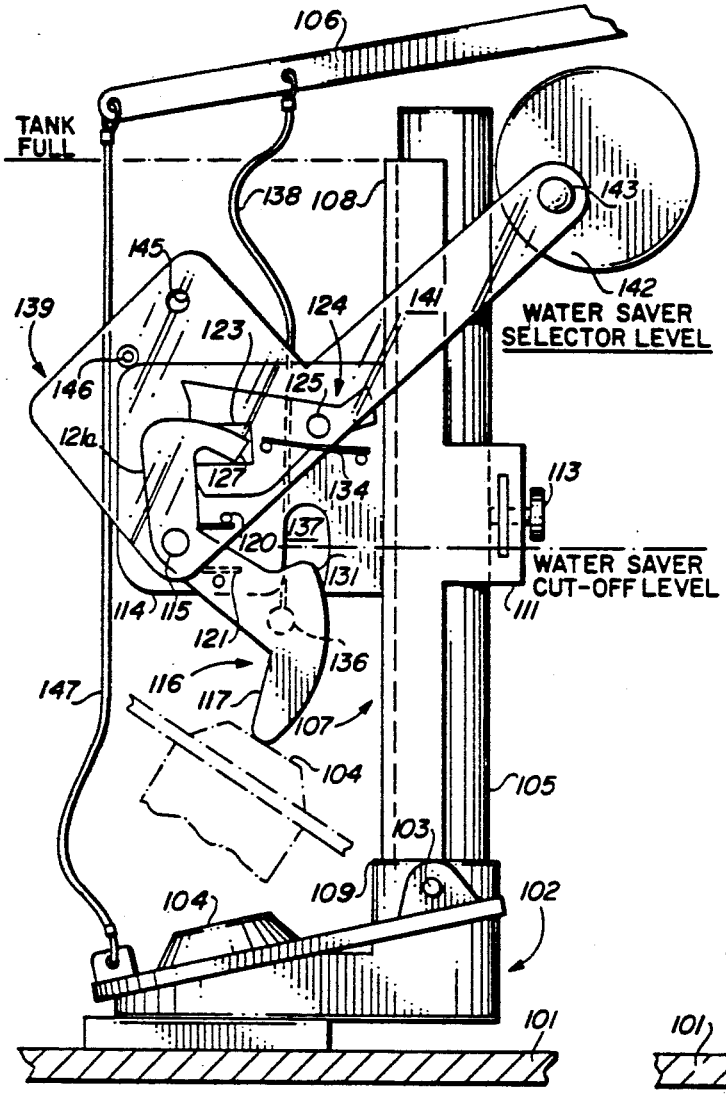
FIG. 7 is a front elevation of a second species of water saver with the parts shown in positions assumed between flushes after a water saver flush.

In FIG. 7, reference character 101 indicates the bottom of a conventional flush tank having an outlet fitting 102 provided with pivots 103 supporting a conventional flapper float type flush valve 104. This outlet fitting also supports a conventional overflow pipe 105 extending above the water lever. The flush tank also includes a conventional flush lever 106 which is raised by pushing down on an external flush lever (not shown).

Figure 9:
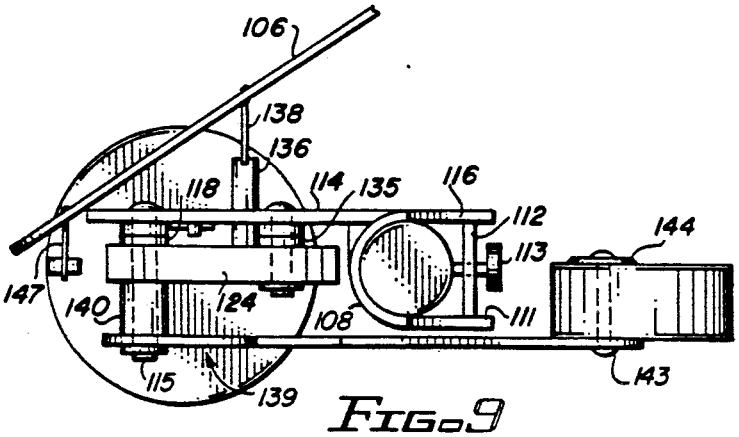
FIG. 9 is a top view of FIG. 7 with the float lever at the water saver cut-off position.
Figure 12:
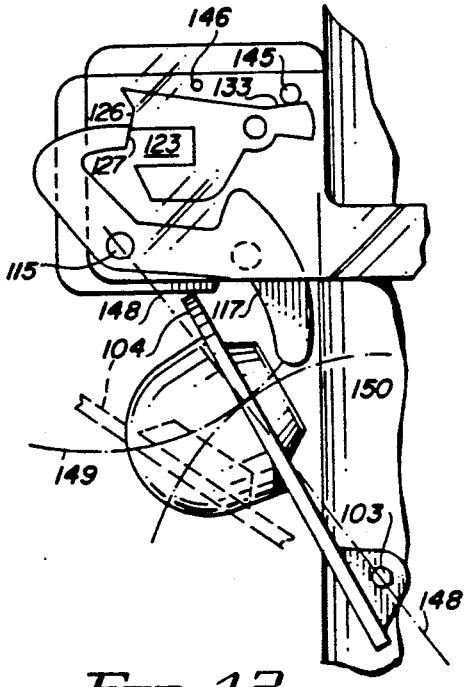
FIG. 12 is a fragmentary view of the parts just before the water saver cut-off.

Mounted on the overflow pipe 105 is a base member generally indicated as 107. This base member includes an elongated semicircular section 108 (FIG. 9) fitting over the overflow pipe 105. This section rests on a shoulder 109 of the outlet fitting 102. It is provided with mounting extensions 111 and 116 extending to the other side of the overflow pipe and carrying a clamping member 112 which carries a set screw 113. Tightening the set screw 113 clamps base member 107 to the overflow pipe. This mounting bracket or base member carries a mechanism support 114 which is molded integral with the base member. This mechanism support carries a shoulder pivot pin 115 located approximately at the water saver level. The pin 115 supports a flapper valve operator generally indicated as 116. This operator has a valve engaging portion 117 extending downwardly and toward the overflow pipe to a point where it engages the back of a flapper valve when opened as shown in FIG. 12. The valve operator also includes a hub 118 which spaces it from support 114 so that it engages the center of the flapper valve 104. This hub and the shoulder on pin 115 support a biasing spring 119. This spring is of a torsion type and has one leg bearing on a pin 120 formed on the mechanism support and its other leg 121 bearing on a pin formed on the valve operator. This spring biases the valve operator downwardly for closing the flapper valve.

The valve operator 116 also includes a latching section **121*a* including an arcuate portion 122 which extends into the slot 123 of latch 124 as shown in FIG. 7. This latch is supported on the mechanism base by a pivot pin 125 which is spaced from the operator pivot pin 115. As better shown in FIG. 11 this latch includes a primary supporting surface 126 which faces away from the pivot 125 and is engaged during a flush by the end 127 of the arcuate section 122 of valve operator 116. This holds the valve operator in inactive position as shown in FIG. 12. The latch also includes a float blocking section 128 merging with the supporting surface 126. It also includes a secondary supporting surface 129 on the other side of notch 123. The latch also has a driven surface 130 which is engaged by a driving surface 131 on the valve operator 116. The latch also includes a driving portion 132 having a driven surface 133. This latch is biased downwardly by a torsion spring 134 fitting over hub 135 on the latch and a shoulder formed on pivot pin 125. This spring bears on a pin formed on the back of a latch and another pin formed on the mechanism base 114**.

The valve operator 116 is provided with a pin 136 which extends rearwardly through a slot 137 in base 114. This pin is connected to the flush lever 106 by a flexible connection 138.

Also mounted on the pivot pin 115 is a float lever generally indicated as 139. This lever is molded of thermo-plastic material which in this illustration is transparent allowing the parts behind it to be shown in full lines. Float lever 139 includes a hub 140 fitting over pivot pin 115 and spacing the lever extension 141 from the base 107. This lever extension extends toward and beyond the overflow pipe and at its end carries a float 142. This float is mounted off-center by a rivet 143 and a tension washer 144 (FIG. 9) allowing rotation of the float on the arm 141. This provides a limited adjustment for the water saver cut-off point. The float lever also includes a rearwardly extending operator pin 145 and a float disabling pin 146 of smaller diameter.

OPERATION

FIG. 7 shows the parts in the positions assumed after a water saving flush and after the tank has refilled. The float 142 is in its uppermost position. The arcuate section 122 of valve operator 116 is in notch 123 of latch 124. This causes portion 117 of the operator to be in its lowermost position where it has pushed the flapper valve 104 to the dotted line position from which it snaps to closed position by the downward flow of water. The flapper valve 104 is now closed and the tank has refilled.

Figure 8:
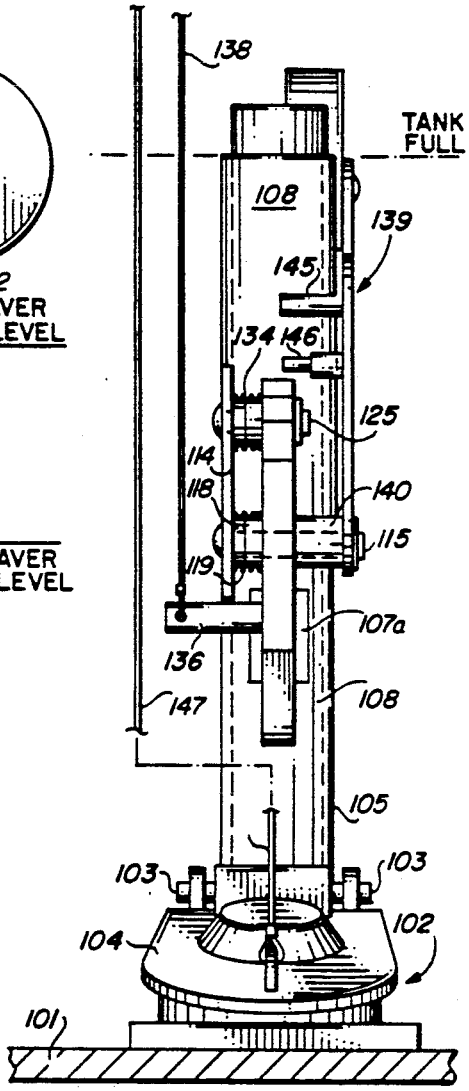
FIG. 8 is a side view of FIG. 7.
Figure 10:
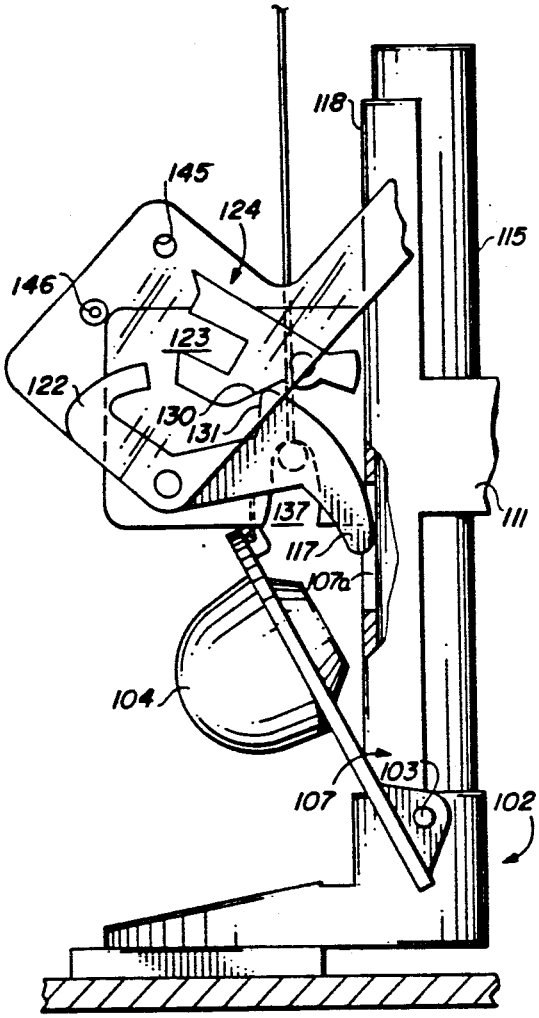
FIG. 10 is a fragmentary view like FIG. 7 but at the start of a flush.

When a flush is desired, the user pushes down on the external flush lever (not shown) which raises the internal flush lever 106. This first takes up slack in link 147 and breaks the flapper valve loose from its seat. At this point the slack in link 138 is taken up and link 138 pulls upwardly on pin 136 which is part of a valve operator. This rotates the valve operator counterclockwise lifting the arcuate portion 122 out of the notch 123 of the latch 124. On continued upward movement of the flush lever 106, the driving portion 131 on the valve operator engages the driven portion 130 of the latch causing the latch to rotate clockwise to the position of FIG. 10. At this time the pin 136 on the operator engages the end of slot 137 in the mechanism base which stops further movement of the valve operator. As shown in FIGS. 8 and 10, the base 107 is provided with a notch **107*a* into which the end 117 of the operator enters. This allows the valve operator 116 to move to the position shown in FIG. 10**.

FULL FLUSH

Figure 13:
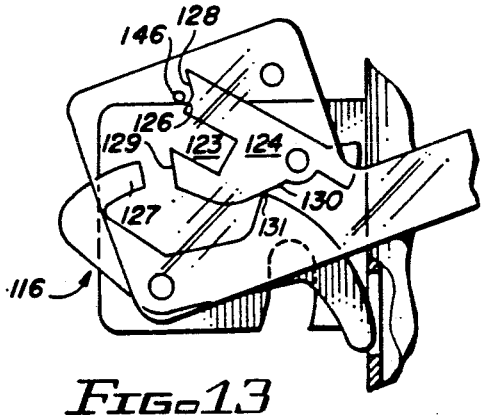
FIG. 13 is a view similar to FIG. 12 but shows the parts at the start of a flush with the handle still held down for a full flush.

When a full flush is desired, the operator holds the flush handle down a couple of seconds until the water level drops to the point marked "Selector Level". At this time the selector pin 146 on the float lever reaches the position shown in FIG. 13. It engages the latching surface 126 of latch 124 behind the blocking surface 128. This stops downward movement of a float thus disabling it from providing a water saver flush. After this selector level is reached the user may release the flush handle allowing the internal flush lever to drop. This permits the valve operator to rotate until its latching end 127 engages the second latching surface 129 on the latch. This holds or locks the operator in the same position shown in FIG. 12, where it allows full open movement of the flapper valve 104. The tank will now empty until the loss of buoyancy causes flapper valve to close in the regular manner. The tank will now refill and the float lever will reassume the position shown in FIG. 7. Latching section 127 on the valve operator will remain engaged with the surface 129 of latch 124 until the start of the next flush.

WATER SAVER FLUSH

Figure 11:
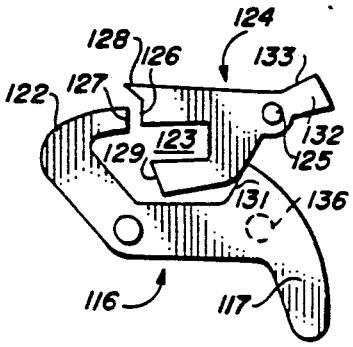
FIG. 11 is a fragmentary view of the parts after a flush is started just after the handle is released for a water saver flush.

When a water saver flush is desired, the user depresses the flush handle and releases it immediately. This allows clockwise rotation of the valve operator 116 which in turn allows counterclockwise rotation of the latch 124. As shown in FIG. 11, the latching surface 126 on the latch comes under the end 127 of the valve operator while end 127 and surface 126 are still spaced apart. The parts are preferably formed so that when end 127 engages surface 126 it also engages projection 128 on the latch which serves as a stop for further movement of the latch. Engagement of the latching surfaces 126 and 127 holds the valve operator in the inactive position shown in FIG. 12 allowing full opening of the flapper valve.

When the water level drops to the water saver cut-off level the float lever reaches the position shown in FIG. 12 where pin 145 on the float lever engages surface 133 of the latch. This rotates the latch until the latching surface 127 drops into the notch 123. This allows the valve operator to rotate back to the position of FIG. 1, pushing the flapper valve to closed position.

It should be noted that the location of pivot 115 for the valve operator relative to pivots 103 for the flapper valve is on a line 148 extending through the areas of contact of the operator with the valve at mid-stroke. The contacting area on the valve operator 117 travels in an arc 149 centered on the pivot pin 115, while the area of contact on the valve with the operator travels in an arc 150 centered on the flapper valve pivots 103. It should be noted these arcs travel in similar directions through the operating stroke of the valve operator. This minimizes rubbing between the two parts and keeps friction loss low.

I claim:

1. A water saver control for a toilet flush tank having an outlet, an overflow pipe means, a flapper float type valve for the outlet mounted on pivots on the overflow pipe means and an externally operated flush lever connected to the flapper valve for opening same on upward movement of the lever, said flapper valve being of the type that holds itself open due to its buoyancy until the tank is empty, the combination of, operator pivot means supported in the tank, a flapper valve operator mounted on said operator pivot means, said operator being constructed to extend from its pivot means to a contact area with the back of the flapper valve when open to push the valve toward closed position against its buoyancy on rocking of the operator in one direction, the location of the operator pivot means being on any line which passes through the flapper valve pivots and through the contact area of the operator with the valve during pushing of the valve by the operator, said pivot means location causing the areas of contact on the flapper valve and operator to travel in similar general directions on moving the flapper valve to closed position, and operating means including a float constructed and arranged to rock the operator in said one direction in response to falling water level.

2. The combination recited in claim 1 in which the pivots for the flapper valve and operator pivot means are arranged to cause the points of contact between the flapper valve and operator to travel in substantially coinciding paths through the operating range of the operator.

3. The combination recited in claim 1 in which the operator includes a pivotally mounted float lever rocked by downward movement of the float, and a link between the float lever and flapper valve operator for causing movement of said operator by movement of said float lever.

4. The combination recited in claim 1 including a locking means for locking the float in an inactive position, said locking means being connected to the flush lever and being engaged by the float when the flush lever is held up while the water level drops.

5. The combination recited in claim 1 in which the flapper valve operator extends upwardly from its pivot means behind the flapper valve when open to push the flapper valve toward closed position.

6. The combination recited in claim 5 including locking means for the operating means arranged when activated to prevent the operating means from closing the valve, thereby causing a full flush, said locking means being controlled conjointly by said float and flush lever, the parts being arranged to activate the locking means when the float lowers to a predetermined level while the flush lever is held up.

7. The combination recited in claim 5 in which the operator pivot means, operating means and float are supported by an elongated rigid base member mounted on the overflow pipe means and having axially spaced apart engaging portions engaging one side of the overflow pipe means, said base member being formed to provide a channel like construction adapted to align the base member generally parallel with the overflow pipe means, and clamping means holding the base member to the overflow pipe means.

8. The combination recited in claim 1 in which the operator pivot means consists of two pivots on opposite sides of the overflow pipe means and in which the lever has two legs, one on each pivot and a crossmember extending across the overflow pipe means from one leg to the other, said crossmember being constructed and arranged to contact the flapper valve.

9. The combination recited in claim 1 in which the operator pivot means is located above the flapper valve and the operator is arranged to extend downwardly from said pivot means to a contact area with the back of the flapper valve.

10. The combination recited in claim 9 in which both the valve operator and float are mounted on the same pivot means.

11. The combination recited in claim 9 in which the pivot means is located vertically in the tank at approximately the water saving level.

12. The combination recited in claim 9 including locking means for the operating means arranged when activated to prevent the operating means from closing the valve, thereby causing a full flush, said locking means being controlled conjointly by said float and flush lever, the parts being arranged to activate the locking means when the float lowers to a predetermined level while the flush lever is held up.

13. The combination recited in claim 9 in which the operator pivot means, operating means and float are supported by an elongated rigid base member mounted on the overflow pipe means and having axially spaced apart engaging portions engaging one side of the overflow pipe means, said base member being formed to provide a channel like construction adapted to align the base member generally parallel with the overflow pipe means, and clamping means holding the base member to the overflow pipe means.

14. The combination recited in claim 1 including locking means for the operating means arranged when activated to prevent the operating means from closing the valve, thereby causing a full flush, said locking means being controlled conjointly by said float and flush lever, the parts being arranged to activate the locking means when the float lowers to a predetermined level while the flush lever is held up.

15. The combination recited in claim 1 in which the operator pivot means, operating means and float are supported by an elongated rigid base member mounted on the overflow pipe means and having axially spaced apart engaging portions engaging one side of the overflow pipe means, said base member being formed to provide a channel like construction adapted to align the base member generally parallel with the overflow pipe means, and clamping means holding the base member to the overflow pipe means.

16. The combination recited in claim 1 in which the contact areas on the flapper valve and operator travel in arcs having travel portions substantially parallel with each other, said line through the pivots passing through said travel portions.

* * * * *